US011905969B2

(12) United States Patent
Iwakiri

(10) Patent No.: US 11,905,969 B2
(45) Date of Patent: Feb. 20, 2024

(54) SCROLL STRUCTURE OF CENTRIFUGAL COMPRESSOR AND CENTRIFUGAL COMPRESSOR

(71) Applicant: MITSUBISHI HEAVY INDUSTRIES ENGINE & TURBOCHARGER, LTD., Sagamihara (JP)

(72) Inventor: Kenichiro Iwakiri, Tokyo (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 52 days.

(21) Appl. No.: 17/614,891

(22) PCT Filed: Jun. 5, 2019

(86) PCT No.: PCT/JP2019/022292

§ 371 (c)(1),
(2) Date: Nov. 29, 2021

(87) PCT Pub. No.: WO2020/245934

PCT Pub. Date: Dec. 10, 2020

(65) Prior Publication Data

US 2022/0235794 A1 Jul. 28, 2022

(51) Int. Cl.
*F04D 29/44* (2006.01)
*F04D 17/10* (2006.01)

(52) U.S. Cl.
CPC ..... *F04D 29/44* (2013.01); *F04D 17/10* (2013.01)

(58) Field of Classification Search
CPC ..... F04D 29/422; F04D 29/428; F04D 29/44; F04D 29/441
See application file for complete search history.

(56) References Cited

U.S. PATENT DOCUMENTS 4,872,809 A * 10/1989 Addie ..... F04D 7/04 415/206
9,541,094 B2 1/2017 Iwakiri et al.
(Continued)

FOREIGN PATENT DOCUMENTS

CN 101668954 A 3/2010
CN 108700090 A 10/2018
(Continued)

OTHER PUBLICATIONS

International Search Report (PCT/ISA/210) issued in PCT/JP2019/022292 dated Jul. 9, 2019.
(Continued)

*Primary Examiner* — Brian O Peters
(74) *Attorney, Agent, or Firm* — Birch, Stewart, Kolasch & Birch, LLP

(57) ABSTRACT

A scroll structure of a centrifugal compressor according to an embodiment is a scroll structure of a centrifugal compressor having a scroll passage formed in spiral shape, comprising: a tongue portion separating the scroll passage from an outlet passage connected to the downstream side of the scroll passage at the most downstream position of the scroll passage in a passage connecting portion where a winding start portion and a winding end portion of the scroll passage intersect; and a ridge portion protruding from an inner peripheral surface of the scroll passage on the axially downstream side of the centrifugal compressor toward the axially upstream side of the centrifugal compressor, with a protruding height toward the axially upstream side gradually increasing toward the tongue portion from a starting position that is located upstream from the tongue portion in the scroll passage. The starting position is a position at an angle of 8 degrees or less in the circumferential direction of the cen-
(Continued)

trifugal compressor from the tongue portion toward the upstream side of the scroll passage.

15 Claims, 6 Drawing Sheets

(56) References Cited

U.S. PATENT DOCUMENTS

| | | | | |
|---|---|---|---|---|
| 9,562,541 | B2 | 2/2017 | Iwakiri et al. | |
| 2007/0014666 | A1* | 1/2007 | White | F04D 29/422 416/179 |
| 2010/0129209 | A1* | 5/2010 | Sugimoto | F04D 29/441 415/203 |
| 2010/0226766 | A1* | 9/2010 | Eguchi | F04D 29/422 415/206 |
| 2011/0142610 | A1* | 6/2011 | Burgess | F04D 7/04 415/204 |
| 2015/0354558 | A1* | 12/2015 | Kawai | F04D 7/045 418/55.1 |
| 2019/0055959 | A1* | 2/2019 | Iwakiri | F04D 29/441 |

FOREIGN PATENT DOCUMENTS

| | | | | |
|---|---|---|---|---|
| JP | 5479316 | B2 | 4/2014 | |
| JP | 5517981 | B2 | 6/2014 | |
| WO | WO-2017168650 | A1 * | 10/2017 | F04D 17/10 |

OTHER PUBLICATIONS

Written Opinion (PCT/ISA/237) issued in PCT/JP2019/022292 dated Jul. 9, 2019.

* cited by examiner

SCROLL STRUCTURE OF CENTRIFUGAL COMPRESSOR AND CENTRIFUGAL COMPRESSOR

TECHNICAL FIELD

The present disclosure relates to a scroll structure of a centrifugal compressor and a centrifugal compressor.

BACKGROUND

A centrifugal compressor used in a compressor section of a vehicle or marine turbocharger provides kinetic energy to a fluid through the rotation of the impeller and obtains a pressure increase due to centrifugal force by discharging the fluid outward in the radial direction.

This centrifugal compressor is required to have a high pressure ratio and high efficiency over a wide operating range.

The centrifugal compressor has a scroll passage formed in spiral shape. The scroll passage has a passage connecting portion where a winding start portion and a winding end portion of the scroll passage intersect.

In such a centrifugal compressor, a recirculation flow from the winding end portion to the winding end portion may occur at the passage connecting portion. When the recirculation flow enters from the winding end portion to the winding start portion, the direction of the flow of fluid is changed at the passage connecting portion, and loss occurs when the fluid separates from the wall surface that forms the scroll passage at the winding start portion. Patent Document 1 discloses a scroll structure of a centrifugal compressor in which the shape of the passage connecting portion is modified to suppress such loss (see Patent Document 1).

CITATION LIST

Patent Literature

Patent Document 1: JP5479316B

SUMMARY

Problems to be Solved

For example, in the scroll structure of a centrifugal compressor described in Patent Document 1, the recirculation flow is suppressed by reducing the cross-sectional area of the passage connecting portion to reduce the loss.

However, there are other causes of the loss at the passage connecting portion. For example, generally, the passage connecting portion has a tongue portion separating the scroll passage from an outlet passage connected to the downstream side of the scroll passage at the most downstream position of the scroll passage in the passage connecting portion. Further, generally, the passage connecting portion has, at a position upstream from the tongue portion in the scroll passage, a ridge portion protruding from an inner peripheral surface of the scroll passage on the downstream side along the flow of fluid entering the centrifugal compressor in the axial direction of the centrifugal compressor (hereinafter, referred to as the axially downstream side) toward the axially upstream side of the centrifugal compressor. This ridge portion is connected to the tongue portion on the downstream side of the scroll passage.

The fluid blown from the diffuser into the scroll passage flows into the scroll passage along the axially downstream inner peripheral surface of the inner peripheral surface of the scroll passage. Further, the fluid blown from the diffuser into the scroll passage has a velocity component that moves outward in the radial direction of the centrifugal compressor. Therefore, in the vicinity of the passage connecting portion, the fluid blown from the diffuser into the scroll passage tries to flow over the ridge portion from the inner side to the outer side in the radial direction of the centrifugal compressor. Such a flow of fluid is toward the upstream side in the axial direction of the centrifugal compressor along the flow of fluid entering the centrifugal compressor (hereinafter referred to as the axially upstream side).

Further, the flow of fluid in the scroll passage has a main flow along the circumferential direction from the winding start portion to the winding end portion and a swirling flow swirling in the scroll passage along the main flow. The swirling flow is toward the axially downstream side.

Therefore, the fluid flow that tries to flow over the ridge portion and the swirling flow interfere with each other, causing the fluid to separate from the inner peripheral surface of the scroll passage near the tongue portion. Such separation causes loss of the centrifugal compressor.

However, Patent Document 1 does not mention the suppression of fluid separation as described above.

In view of the above, an object of at least one embodiment of the present invention is to provide a scroll structure of a centrifugal compressor and a centrifugal compressor with high efficiency over a wide operating range.

Solution to the Problems (1) A scroll structure of a centrifugal compressor according to at least one embodiment of the present invention is a scroll structure of a centrifugal compressor having a scroll passage formed in spiral shape, comprising: a tongue portion separating the scroll passage from an outlet passage connected to a downstream side of the scroll passage at a most downstream position of the scroll passage in a passage connecting portion where a winding start portion and a winding end portion of the scroll passage intersect; and a ridge portion protruding from an inner peripheral surface of the scroll passage on an axially downstream side of the centrifugal compressor toward an axially upstream side of the centrifugal compressor, wherein a protruding height of the ridge portion protruding toward the axially upstream side gradually increases toward the tongue portion from a starting position that is located upstream from the tongue portion in the scroll passage. The starting position is a position at an angle of 8 degrees or less in a circumferential direction of the centrifugal compressor from the tongue portion toward an upstream side of the scroll passage.

As described above, when the fluid flow that tries to flow over the ridge portion and the swirling flow in the scroll passage interfere with each other, the fluid may separate from the inner peripheral surface of the scroll passage near the tongue portion. Therefore, it is desirable to suppress the interference between the fluid flow that tries to flow over the ridge portion and the swirling flow in the scroll passage.

Typically, the starting position is at an angle of about 15 degrees in the circumferential direction of the centrifugal compressor from the tongue portion toward the upstream side of the scroll passage.

In contrast, in the above configuration (1), the starting position is at an angle of 8 degrees or less in the circumferential direction of the centrifugal compressor from the tongue portion toward the upstream side of the scroll passage. Accordingly, in the above configuration (1), the range where the ridge portion extends in the circumferential direction of the centrifugal compressor is reduced compared to a typical centrifugal compressor.

Since the ridge portion is a portion protruding from the axially downstream inner peripheral surface of the inner peripheral surface of the scroll passage toward the axially upstream side, by reducing the range where the ridge portion extends in the circumferential direction of the centrifugal compressor, the interference between the fluid flow that tries to flow over the ridge portion and the swirling flow in the scroll passage can be suppressed.

Therefore, with the above configuration (1), the separation of fluid from the inner peripheral surface of the scroll passage can be suppressed, and the loss due to the separation can be suppressed. Therefore, it is possible to increase the efficiency of the centrifugal compressor over a wide operating range.

(2) A scroll structure of a centrifugal compressor according to at least one embodiment of the present invention is a scroll structure of a centrifugal compressor having a scroll passage formed in spiral shape, comprising: a tongue portion separating the scroll passage from an outlet passage connected to a downstream side of the scroll passage at a most downstream position of the scroll passage in a passage connecting portion where a winding start portion and a winding end portion of the scroll passage intersect; and a ridge portion protruding from an inner peripheral surface of the scroll passage on an axially downstream side of the centrifugal compressor toward an axially upstream side of the centrifugal compressor, wherein a protruding height of the ridge portion protruding toward the axially upstream side gradually increases toward the tongue portion from a starting position that is located upstream from the tongue portion in the scroll passage. The protruding height in a position at an angle of 4 degrees in a circumferential direction of the centrifugal compressor from the tongue portion toward an upstream side of the scroll passage is 10% or less of a height dimension of the scroll passage at the winding start portion along an axial direction of the centrifugal compressor.

The ridge portion of a typical centrifugal compressor extends in the range about 15 degrees in the circumferential direction of the centrifugal compressor, as described above. Further, in a typical centrifugal compressor, the protruding height of the ridge portion at the connecting position with the tongue portion is often more than 50% of the height dimension of the scroll passage at the winding start portion along the axial direction of the centrifugal compressor. Consequently, in the ridge portion of a typical centrifugal compressor, the protruding height of the ridge portion in the position at an angle of 4 degrees in the circumferential direction of the centrifugal compressor from the tongue portion toward the upstream side of the scroll passage is often more than 30% of the height dimension of the scroll passage at the winding start portion along the axial direction of the centrifugal compressor.

Therefore, with the above configuration (2), since the protruding height of the ridge portion in the position at an angle of 4 degrees in the circumferential direction of the centrifugal compressor from the tongue portion toward the upstream side of the scroll passage is 10% or less of the height dimension of the scroll passage at the winding start portion along the axial direction of the centrifugal compressor, the protruding height of the ridge portion near the tongue portion can be made smaller than the protruding height of the ridge portion in a typical centrifugal compressor. Therefore, with the above configuration (2), the interference between the fluid flow that tries to flow over the ridge portion and the swirling flow in the scroll passage can be suppressed.

Therefore, with the above configuration (2), the separation of fluid from the inner peripheral surface of the scroll passage can be suppressed, and the loss due to the separation can be suppressed. Therefore, it is possible to increase the efficiency of the centrifugal compressor over a wide operating range.

(3) A scroll structure of a centrifugal compressor according to at least one embodiment of the present invention is a scroll structure of a centrifugal compressor having a scroll passage formed in spiral shape, comprising: a tongue portion separating the scroll passage from an outlet passage connected to a downstream side of the scroll passage at a most downstream position of the scroll passage in a passage connecting portion where a winding start portion and a winding end portion of the scroll passage intersect; and a ridge portion protruding from an inner peripheral surface of the scroll passage on an axially downstream side of the centrifugal compressor toward an axially upstream side of the centrifugal compressor, wherein a protruding height of the ridge portion protruding toward the axially upstream side gradually increases toward the tongue portion from a starting position that is located upstream from the tongue portion in the scroll passage. The protruding height is 30% or less of a height dimension of the scroll passage at the winding start portion along an axial direction of the centrifugal compressor.

As a result of intensive studies by the inventors, it has been found that when the protruding height of the ridge portion is 30% or less of the height dimension of the scroll passage at the winding start portion along the axial direction of the centrifugal compressor, the effect of suppressing the separation of fluid from the inner peripheral surface of the scroll passage is particularly improved.

Therefore, with the above configuration (3), the separation of fluid from the inner peripheral surface of the scroll passage can be effectively suppressed, and the loss due to the separation can be effectively suppressed.

(4) A scroll structure of a centrifugal compressor according to at least one embodiment of the present invention is a scroll structure of a centrifugal compressor having a scroll passage formed in spiral shape, comprising: a tongue portion separating the scroll passage from an outlet passage connected to a downstream side of the scroll passage at a most downstream position of the scroll passage in a passage connecting portion where a winding start portion and a winding end portion of the scroll passage intersect; and a ridge portion protruding from an inner peripheral surface of the scroll passage on an axially downstream side of the centrifugal compressor toward an axially upstream side of the centrifugal compressor, wherein a protruding height of the ridge portion protruding toward the axially upstream side gradually increases toward the tongue portion from a starting position that is located upstream from the tongue portion in the scroll passage. The curvature radius of a curve connecting an apex of the ridge portion defining the protruding height from the tongue portion to the starting position is located on the axially upstream side, and the curvature radius gradually increases from the tongue portion to the starting position in at least a portion of the apex.

In the above configuration (4), the curvature radius of a curve connecting the apex of the ridge portion from the tongue portion to the starting position gradually decreases from the starting position to the tongue portion in at least a portion of the apex defining the protruding height. Accordingly, the amount of decrease in the protruding height when moving a small distance from the tongue portion toward the starting position is greater in the area closer to the connecting position with the tongue portion where the protruding height is the highest. Therefore, when moving from the tongue portion toward the starting position, the protruding height decreases more steeply in the area close to the connecting position with the tongue portion than in the area far from the connecting position with the tongue portion. Therefore, with the above configuration (4), since the protruding height is reduced as a whole, the interference between the fluid flow that tries to flow over the ridge portion and the swirling flow in the scroll passage can be suppressed. As a result, the separation of fluid from the inner peripheral surface of the scroll passage can be suppressed, and the loss due to the separation can be suppressed.

(5) In some embodiments, in any one of the above configurations (1) to (4), a flow passage shape of the scroll passage in a cross-section extending in a direction perpendicular to a centerline of the scroll passage is not circular in the cross-section including the tongue portion, and a flow passage shape of the outlet passage in a cross-section extending in a direction perpendicular to a centerline of the outlet passage approaches circular as the outlet passage extends downstream from a connecting position with the scroll passage, and is circular at a position downstream, in the outlet passage, from the connecting position by a distance equal to or greater than a passage height at the winding end portion along an axial direction of the centrifugal compressor.

Generally, in a centrifugal compressor, the flow passage shape (hereinafter referred to simply as cross-sectional shape) of the scroll passage in a cross-section extending in the direction perpendicular to the centerline of the scroll passage is not circular in the cross-section including the tongue portion. On the other hand, the flow passage shape (cross-sectional shape) of the outlet passage in a cross-section extending in the direction perpendicular to the extension direction of the passage is typically circular. Therefore, if the cross-sectional shape of the passage changes abruptly from the scroll passage to the outlet passage, loss occurs, resulting in a decrease in the efficiency of the centrifugal compressor.

As a result of intensive studies by the inventors, it has been found that when the cross-sectional shape of the passage is made approach circular over a distance equal to or greater than the passage height of the winding end portion along the axial direction of the centrifugal compressor as in the above configuration (5), the loss can be effectively reduced.

Therefore, with the above configuration (5), it is possible to effectively suppress the loss occurring in the passage from the scroll passage to the outlet passage, and it is possible to increase the efficiency of the centrifugal compressor over a wide operating range.

(6) A centrifugal compressor according to at least one embodiment of the present invention comprises the scroll structure of a centrifugal compressor having any one of the above configurations (1) to (5) to increase the efficiency over a wide operating range.

Advantageous Effects

According to at least one embodiment of the present invention, it is possible to increase the efficiency of the centrifugal compressor over a wide operating range.

DETAILED DESCRIPTION

Embodiments of the present invention will now be described in detail with reference to the accompanying drawings. It is intended, however, that unless particularly identified, dimensions, materials, shapes, relative positions, and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

Figure 1:
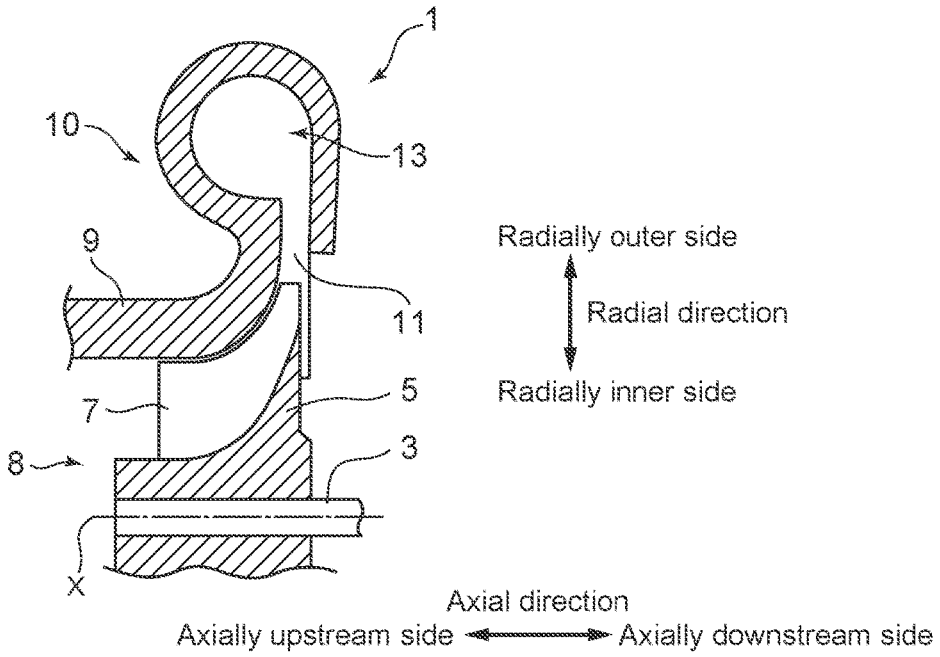
FIG. 1 is a cross-sectional view of a centrifugal compressor according to some embodiments.

FIG. 1 is a cross-sectional view of a centrifugal compressor 1 according to some embodiments. The centrifugal compressor 1 according to some embodiments is a centrifugal compressor 1 used in a turbocharger. In the centrifugal compressor 1 according to some embodiments, a turbine wheel of a turbine (not shown) and a compressor wheel 8 are connected by a rotational shaft 3. The compressor wheel 8 has a plurality of compressor blades 7 provided on the surface of a hub 5 to stand. In the compressor wheel 8, the outer side of the compressor blades 7 is covered with a compressor housing (casing) 9. In the centrifugal compressor 1 according to some embodiments, a diffuser 11 is formed on the outer peripheral side of the compressor blades 7, and a scroll passage 13 is further disposed around the diffuser 11 in a spiral shape.

Figure 2:
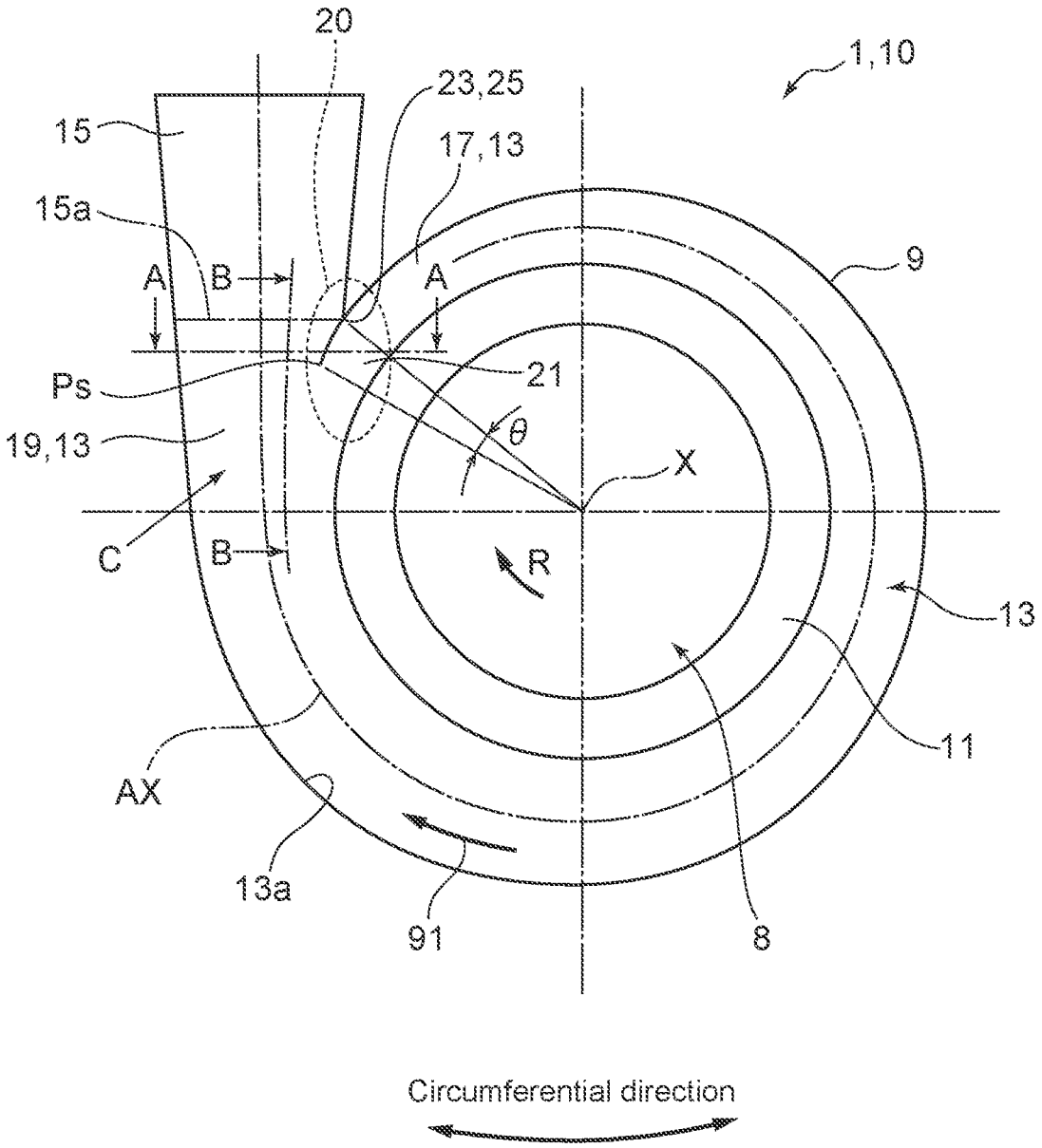
FIG. 2 is a schematic cross-sectional view of a casing of a centrifugal compressor according to some embodiments, when cut along a cross-section perpendicular to the axial direction of the rotational shaft of the centrifugal compressor.

FIG. 2 is a schematic cross-sectional view of the casing 9 of the centrifugal compressor 1 according to some embodiments, when cut along a cross-section perpendicular to the direction of the axis X of the rotational shaft 3 of the centrifugal compressor 1. The casing 9 includes a scroll passage 13 and an outlet passage 15 connected to the downstream side of the scroll passage 13. The scroll passage 13 has a winding start portion 17 and a winding end portion 19 of the scroll passage. The scroll passage 13 is formed such that the cross-sectional area increases as it progresses clockwise from the winding start portion 17 as shown in FIG. 2.

In FIG. 2, the rotational direction of the compressor wheel 8 is represented by the arrow R. In the centrifugal compressor 1 according to some embodiments, the compressor wheel 8 rotates clockwise in FIG. 2.

The flow of fluid in the scroll passage 13 has a main flow 91 (see FIG. 2) along the circumferential direction from the winding start portion 17 to the winding end portion 19 and a swirling flow 93 (see FIG. 5 described later) swirling in the scroll passage 13 along the main flow 91.

In the following description, the direction of the axis X of the rotational shaft 3 of the centrifugal compressor 1 is referred to as the axial direction of the centrifugal compressor 1 or simply the axial direction. Of the axial direction, the upstream side along the flow of fluid entering the centrifugal compressor 1 is referred to as the axially upstream side, and the opposite side is referred to as the axially downstream side. Further, in the following description, the radial direction of the compressor wheel 8 of the centrifugal compressor 1 is referred to as the radial direction of the centrifugal compressor 1 or simply the radial direction. Of the radial direction, the direction toward the axis X of the rotational shaft 3 is referred to as the radially inner side, and the direction away from the axis X of the rotational shaft 3 is referred to as the radially outer side.

Further, in the scroll passage 13 and the outlet passage 15, of the extension direction of the passage, the upstream side of the main flow of fluid is referred to as the upstream side of the scroll passage 13 and the upstream side of the outlet passage 15, and the downstream side of the main flow of fluid is referred to as the downstream side of the scroll passage 13 and the downstream side of the outlet passage 15. The upstream side of the scroll passage 13 and the upstream side of the outlet passage 15 is also simply referred to as the upstream side, and the downstream side of the scroll passage 13 and the downstream side of the outlet passage 15 is also simply referred to as the downstream side. In the scroll passage 13, the extension direction of the scroll passage 13 is almost the same as the circumferential direction of the centrifugal compressor 1.

In the scroll structure 10 of the centrifugal compressor 1 according to some embodiments, the casing 9 has a passage connecting portion 20 where the winding start portion 17 and the winding end portion 19 of the scroll passage 13 intersect. The passage connecting portion 20 has an opening portion 21 formed on the inner peripheral surface 13*a* of the scroll passage 13 at the winding end portion 19 to communicate with the winding start portion 17. A tongue portion 25 separating the scroll passage 13 from the outlet passage 15 is formed at the most downstream position of the scroll passage 13 in an opening forming portion 23 which surrounds the opening portion 21.

Figure 3:
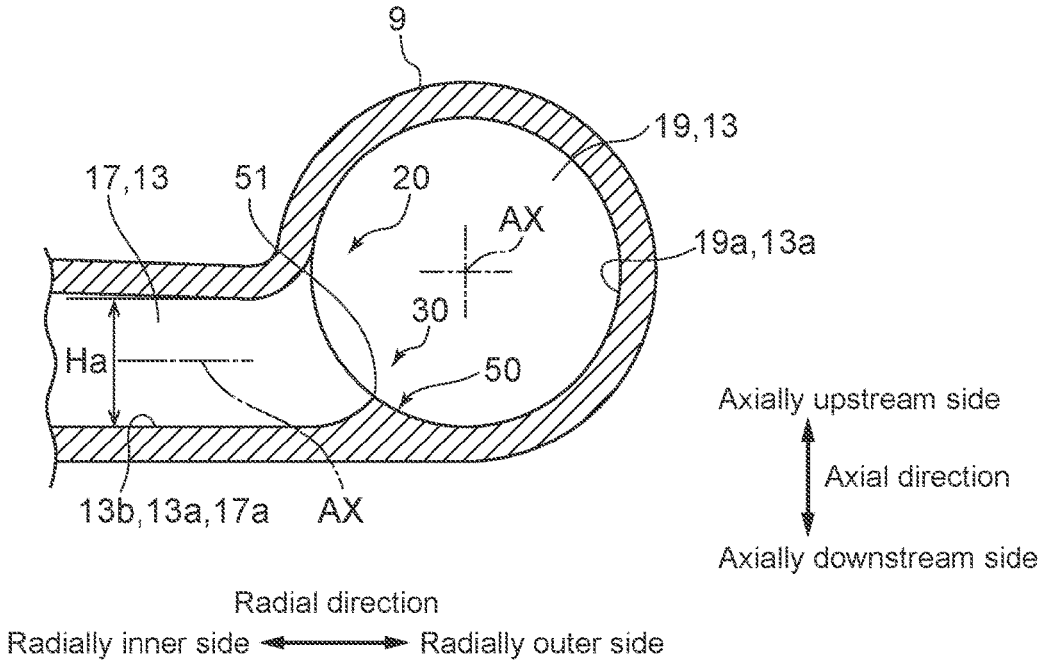
FIG. 3 is a cross-sectional view taken along line A-A in FIG. 2.

FIG. 3 is a cross-sectional view taken along line A-A in FIG. 2. That is, FIG. 3 is a schematic cross-sectional view of the casing 9 when the casing 9 is cut along a cross-section extending in the direction perpendicular to the extension direction of the winding end portion 19 at the position including the passage connecting portion 20. FIG. 3 also shows the inside of the scroll passage 13 at the winding end portion 19 when viewed from the downstream side to the upstream side of the outlet passage 15. In FIG. 3, the diffuser 11 is not depicted.

Figure 4:
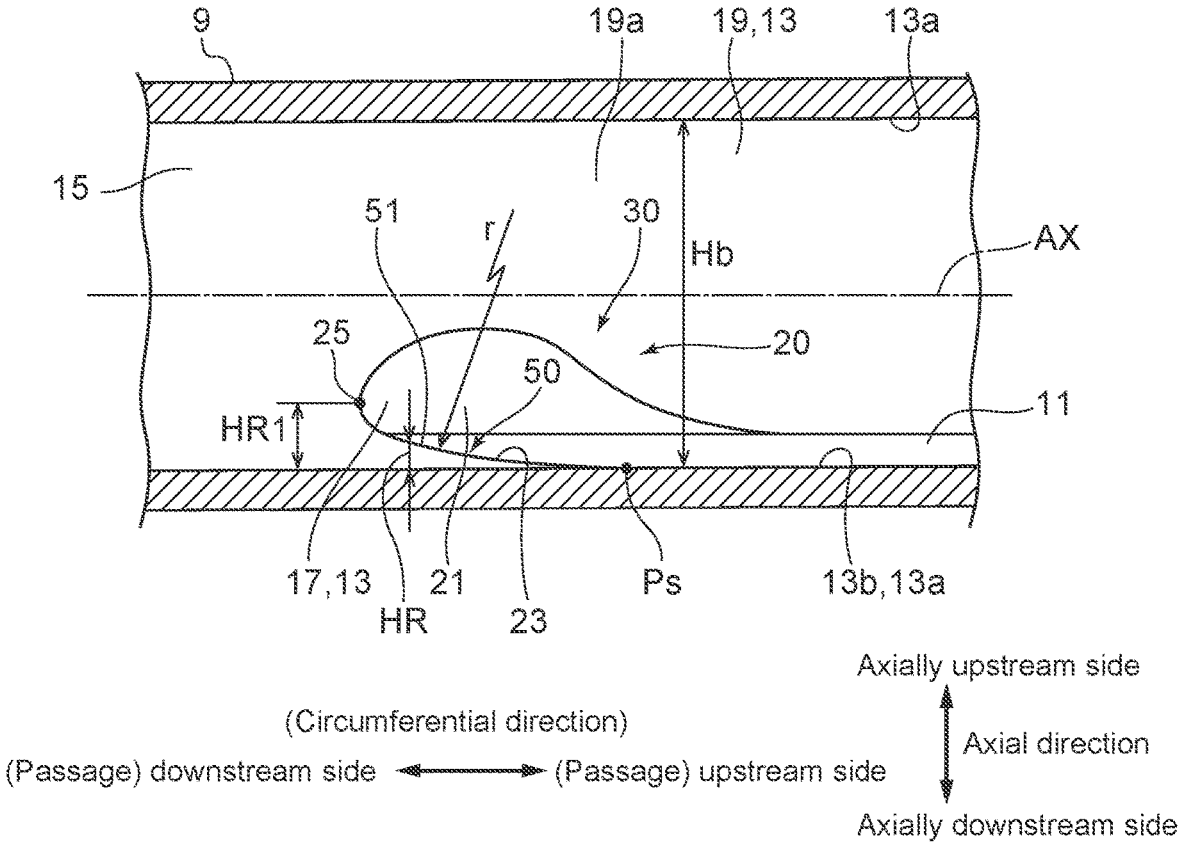
FIG. 4 is a cross-sectional view taken along line B-B in FIG. 2.

FIG. 4 is a cross-sectional view taken along line B-B in FIG. 2. That is, FIG. 4 is a schematic cross-sectional view of the casing 9 when the casing 9 is cut along a cross-section extending in substantially the same direction as the extension direction of the winding end portion 19 and extending in the axial direction of the centrifugal compressor 1. FIG. 4 also shows the inside of the scroll passage 13 at the winding end portion 19 when viewed from the radially outer side of the centrifugal compressor 1.

Figure 5:
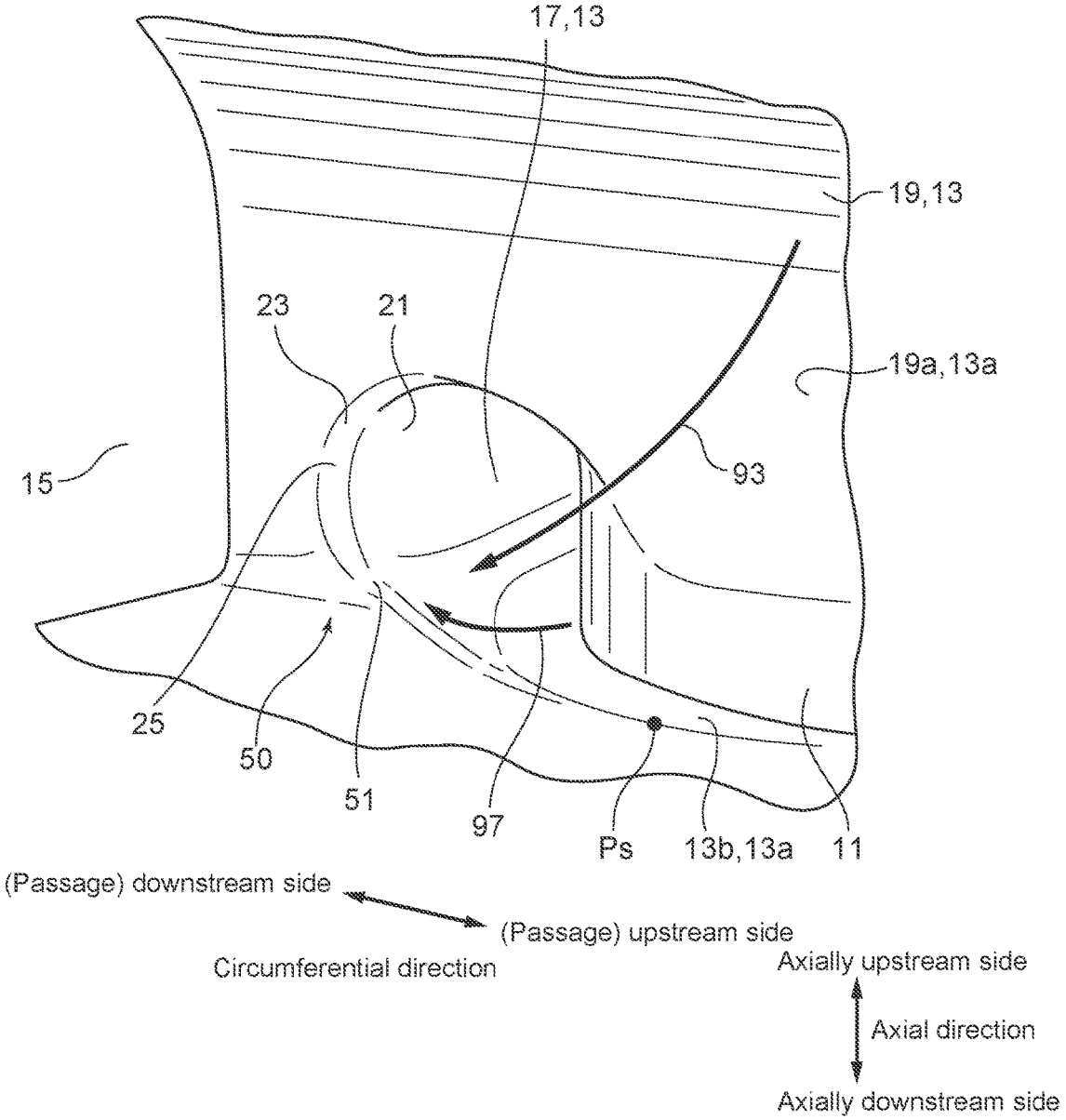
FIG. 5 is a schematic perspective view of the inside of the scroll passage when viewed from the direction C in FIG. 2.

FIG. 5 is a schematic perspective view of the inside of the scroll passage 13 when viewed from the direction C in FIG. 2.

In some embodiments, the casing 9 has a ridge portion 50. In some embodiments, the ridge portion 50 is a portion protruding from the inner peripheral surface 13*a* of the scroll passage 13 on the axially downstream side of the centrifugal compressor toward the axially upstream side of the centrifugal compressor 1. In some embodiments, the protruding height HR protruding toward the axially upstream side gradually increases toward the tongue portion 25 from a starting position Ps that is located upstream from the tongue portion 25 in the scroll passage 13. In other words, in some embodiments, the ridge portion 50 begins to protrude at the starting position Ps toward the axially upstream side from the inner peripheral surface 13*a* on the axially downstream side of the scroll passage 13, and gradually increases its protruding height HR toward the tongue portion 25. In some embodiments, the ridge portion 50 is connected to the tongue portion 25 on the downstream side of the scroll passage 13.

In some embodiments, the inner peripheral surface 17*a* of the winding start portion 18 on the axially downstream side and the inner peripheral surface 19*a* of the winding end portion 19 on the axially downstream side are in the same position in the axial direction of the centrifugal compressor 1.

In some embodiments, the ridge portion 50 extends along the circumferential direction of the centrifugal compressor 1 from the starting position Ps toward the tongue portion 25.

In the following description, the center of the scroll passage 13, i.e., the position through which the centerline AX passes is the center of gravity (centroid) of the scroll passage 13 in a virtual cross-section that extends the scroll passage 13 in the radial direction of the centrifugal compressor 1 and in the axis X direction of the rotational shaft 3.

Hereinafter, the connection region 30 according to some embodiments will be described in detail.

The fluid blown from the diffuser 11 into the scroll passage 13 flows into the scroll passage 13 along the axially downstream inner peripheral surface 13*b* of the inner peripheral surface 13*a* of the scroll passage 13. Further, the fluid blown from the diffuser 11 into the scroll passage 13 has a velocity component that moves outward in the radial direction of the centrifugal compressor 1. Therefore, in the vicinity of the passage connecting portion 20, the fluid blown from the diffuser 11 into the scroll passage 13 tries to flow over the ridge portion 50 from the inner side to the outer side in the radial direction of the centrifugal compressor 1 as shown by the arrow 97. Such a flow of fluid is toward the axially upstream side.

Further, the flow of fluid in the scroll passage 13 has the main flow 91 and a swirling flow 93 swirling in the scroll passage 13 along the main flow 91. The swirling flow 93 is toward the axially downstream side.

Therefore, the fluid flow that tries to flow over the ridge portion 50 as shown by the arrow 97 and the swirling flow 93 interfere with each other, causing the fluid to separate from the inner peripheral surface 13*a* of the scroll passage 13 near the tongue portion 25. Such separation causes loss of the centrifugal compressor 1.

Therefore, in some embodiments, the shape of the ridge portion 50 is designed as described below to suppress the interference between the fluid flow that tries to flow over the ridge portion 50 as shown by the arrow 97 and the swirling flow 93 in the scroll passage 13.

Specifically, in some embodiments, the starting position Ps is at an angle θ of 8 degrees or less in the circumferential direction of the centrifugal compressor 1 from the tongue portion 25 toward the upstream side of the scroll passage 13. In some embodiments, the starting position Ps is preferably at an angle θ of 4 degrees or less.

In a typical centrifugal compressor, the starting position Ps is at an angle θ of about 15 degrees.

In contrast, in some embodiments, the starting position Ps is at an angle θ of 8 degrees or less.

Accordingly, in some embodiments, the range where the ridge portion 50 extends in the circumferential direction of the centrifugal compressor 1 is reduced compared to a typical centrifugal compressor.

Since the ridge portion 50 is a portion protruding from the axially downstream inner peripheral surface 13*b* of the inner peripheral surface 13*a* of the scroll passage 13 toward the axially upstream side, by reducing the range where the ridge portion 50 extends in the circumferential direction of the centrifugal compressor 1, the interference between the fluid flow that tries to flow over the ridge portion 50 as shown by the arrow 97 and the swirling flow 93 in the scroll passage 13 can be suppressed.

Therefore, according to some embodiments, the separation of fluid from the inner peripheral surface 13*a* of the scroll passage 13 can be suppressed, and the loss due to the separation can be suppressed. Therefore, it is possible to increase the efficiency of the centrifugal compressor 1 over a wide operating range.

Figure 7:
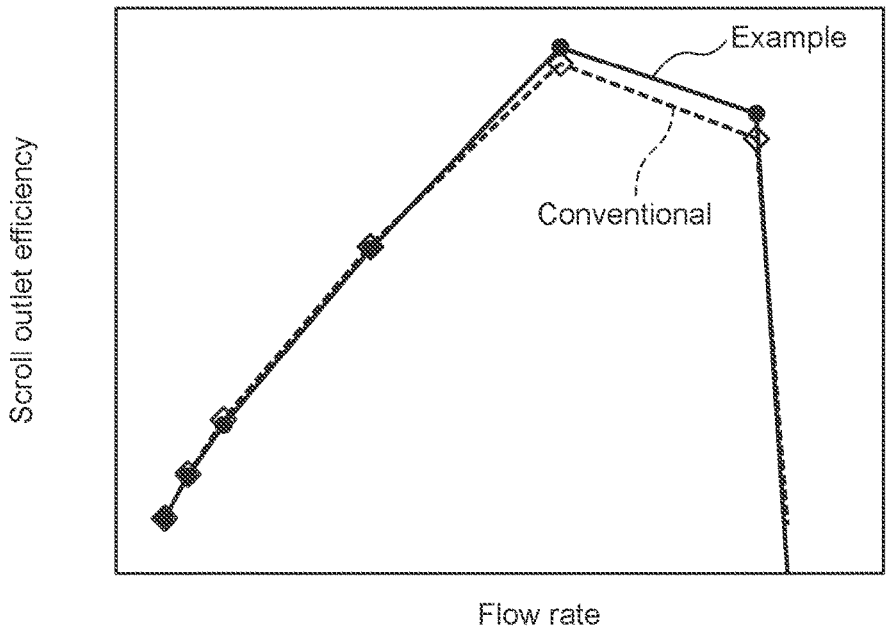
FIG. 7 is a graph showing a relationship between the scroll outlet efficiency and the flow rate in the centrifugal compressor according to the above-described embodiments and a conventional centrifugal compressor.

FIG. 7 is a graph showing a relationship between the scroll outlet efficiency and the flow rate in the centrifugal compressor 1 according to the above-described embodiments and a conventional centrifugal compressor. In FIG. 7, the graph shown by the solid line is a graph for the centrifugal compressor 1 according to the above-described embodiments, and the graph shown by the dashed line is a graph for a conventional centrifugal compressor. As shown in FIG. 7, the scroll outlet efficiency is improved mainly in the large flow rate region by setting the starting position Ps to the position at an angle θ of 8 degrees or less.

In some embodiments, the protruding height HR in the position at an angle θ of 4 degrees in the circumferential direction of the centrifugal compressor 1 from the tongue portion 25 toward the upstream side of the scroll passage 13 is 10% or less of the height dimension Ha of the scroll passage 13 at the winding start portion 17 along the axial direction of the centrifugal compressor 1.

The ridge portion 50 of a typical centrifugal compressor extends in the range about 15 degrees in the circumferential direction of the centrifugal compressor, as described above. Further, in a typical centrifugal compressor, the protruding height HR1 of the ridge portion 50 at the connecting position with the tongue portion 25 is often more than 50% of the height dimension Ha of the scroll passage 13 at the winding start portion 17 along the axial direction of the centrifugal compressor. Consequently, in the ridge portion 50 of a typical centrifugal compressor, the protruding height HR of the ridge portion 50 in the position at an angle θ of 4 degrees in the circumferential direction of the centrifugal compressor from the tongue portion 25 toward the upstream side of the scroll passage 13 is often more than 30% of the height dimension Ha of the scroll passage 13 at the winding start portion 17 along the axial direction of the centrifugal compressor.

Therefore, according to some embodiments, since the protruding height HR of the ridge portion 50 in the position at an angle θ of 4 degrees in the circumferential direction of the centrifugal compressor 1 from the tongue portion 25 toward the upstream side of the scroll passage 13 is 10% or less of the height dimension Ha of the scroll passage 13 at the winding start portion 17 along the axial direction of the centrifugal compressor 1, the protruding height HR of the ridge portion 50 near the tongue portion 25 can be made smaller than the protruding height HR of the ridge portion 50 in a typical centrifugal compressor. Therefore, according to some embodiments, the interference between the fluid flow that tries to flow over the ridge portion 50 as shown by the arrow 97 and the swirling flow 93 in the scroll passage 13 can be suppressed.

Therefore, according to some embodiments, the separation of fluid from the inner peripheral surface 13*a* of the scroll passage 13 can be suppressed, and the loss due to the separation can be suppressed. Therefore, it is possible to increase the efficiency of the centrifugal compressor 1 over a wide operating range.

In some embodiments, the protruding height HR in the position at an angle θ of 4 degrees in the circumferential direction of the centrifugal compressor 1 from the tongue portion 25 toward the upstream side of the scroll passage 13 is 20% or less of the protruding height HR1 in the connecting position with the tongue portion 25.

The ridge portion 50 of a typical centrifugal compressor extends in the range about 15 degrees in the circumferential direction of the centrifugal compressor, as described above. Consequently, in the ridge portion 50 of a typical centrifugal compressor, the protruding height HR of the ridge portion 50 in the position at an angle of 4 degrees in the circumferential direction of the centrifugal compressor from the tongue portion 25 toward the upstream side of the scroll passage 13 is often more than 50% of the protruding height HR1 in the connecting position with the tongue portion 25.

Therefore, according to some embodiments, since the protruding height HR of the ridge portion 50 in the position at an angle θ of 4 degrees in the circumferential direction of the centrifugal compressor 1 from the tongue portion 25 toward the upstream side of the scroll passage 13 is 20% or less of the protruding height HR1 in the connecting position with the tongue portion 25, the protruding height HR of the ridge portion 50 near the tongue portion 25 can be made smaller than the protruding height of the ridge portion of a typical centrifugal compressor. Therefore, according to some embodiments, the interference between the fluid flow that tries to flow over the ridge portion 50 as shown by the arrow 97 and the swirling flow 93 in the scroll passage 13 can be suppressed.

Therefore, according to some embodiments, the separation of fluid from the inner peripheral surface 13*a* of the scroll passage 13 can be suppressed, and the loss due to the separation can be suppressed. Therefore, it is possible to increase the efficiency of the centrifugal compressor 1 over a wide operating range.

The embodiment in which the protruding height HR in the position at an angle θ of 4 degrees is 20% or less of the protruding height HR1 may be implemented in combination with the embodiment in which the starting position Ps is at an angle θ of 8 degrees or less or other embodiments described later, or may be implemented alone.

Further, in some embodiments, the protruding height HR of the ridge portion 50 is 30% or less of the height dimension Ha of the scroll passage 13 at the winding start portion 17 along the axial direction of the centrifugal compressor 1.

As a result of intensive studies by the inventors, it has been found that when the protruding height HR of the ridge portion 50 is 30% or less of the height dimension Ha of the scroll passage 13 at the winding start portion 17 along the axial direction of the centrifugal compressor 1, the effect of suppressing the separation of fluid from the inner peripheral surface 13*a* of the scroll passage 13 is particularly improved.

Therefore, according to some embodiments, the separation of fluid from the inner peripheral surface 13*a* of the scroll passage 13 can be effectively suppressed, and the loss due to the separation can be effectively suppressed.

The embodiment in which the protruding height HR of the ridge portion 50 is 30% or less of the height dimension Ha may be implemented in combination with the embodiment in which the starting position Ps is at an angle θ of 8 degrees or less or the embodiment in which the protruding height HR in the position at an angle θ of 4 degrees is 20% or less of the protruding height HR1, or may be implemented alone. Further, the embodiment in which the protruding height HR of the ridge portion 50 is 30% or less of the height dimension Ha may be implemented in combination with the other embodiments described later.

In some embodiments, the curvature radius r (see FIG. 4) of a curve connecting the apex 51 of the ridge portion 50 defining the protruding height HR from the tongue portion 25 to the starting position Ps is located on the axially upstream side.

The curvature radius r gradually increases from the tongue portion 25 to the starting position Ps in at least a portion of the apex 51.

In other words, in some embodiments, the curvature radius r of a curve connecting the apex 51 from the tongue portion 25 to the starting position Ps gradually decreases from the starting position Ps to the tongue portion 25 in at least a portion of the apex 51. Accordingly, the amount of decrease (dHR) in the protruding height HR when moving a small distance dX from the tongue portion 25 toward the starting position Ps is greater in the area closer to the connecting position with the tongue portion 25 where the protruding height HR is the highest.

Therefore, when moving from the tongue portion 25 toward the starting position Ps, the protruding height HR decreases more steeply in the area close to the connecting position with the tongue portion 25 than in the area far from the connecting position with the tongue portion 25. Therefore, according to some embodiments, since the protruding height HR is reduced as a whole, the interference between the fluid flow that tries to flow over the ridge portion 50 as shown by the arrow 97 and the swirling flow 93 in the scroll passage 13 can be suppressed. As a result, the separation of fluid from the inner peripheral surface 13*a* of the scroll passage 13 can be suppressed, and the loss due to the separation can be suppressed.

The embodiment in which the curvature radius r gradually increases from the tongue portion 25 toward the starting position Ps may be implemented in combination with at least one of the above-described embodiments, or may be implemented alone. Further, the embodiment in which the curvature radius r gradually increases from the tongue portion 25 toward the starting position Ps may be implemented in combination with the other embodiments described later.

Figure 6:
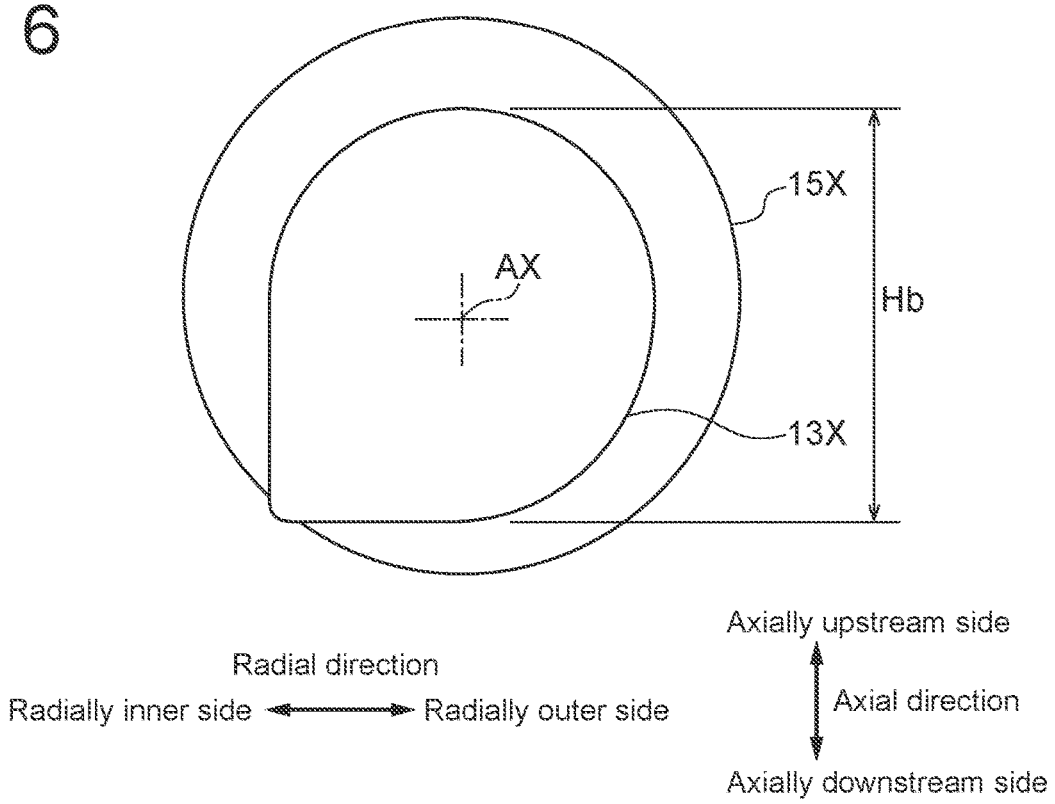
FIG. 6 is a schematic diagram showing the flow passage shape of the scroll passage at the winding end portion and the flow passage shape of the outlet passage.

FIG. 6 is a schematic diagram showing the flow passage shape of the scroll passage 13 at the winding end portion 19 and the flow passage shape of the outlet passage 15, each viewed from the downstream side of the outlet passage 15.

In some embodiments, for example as shown in FIGS. 5 and 6, the flow passage shape 13X of the scroll passage 13 in a cross-section extending in the direction perpendicular to the centerline AX of the scroll passage 13 is not circular in the cross-section including the tongue portion 25.

Further, in some embodiments, the flow passage shape 15X of the outlet passage 15 in a cross-section extending in the direction perpendicular to the centerline AX of the outlet passage 15 approaches circular as the outlet passage 15 extends downstream from a connecting position 15*a* (see FIG. 2) with the scroll passage 13, and the flow passage shape 15X is circular at a position downstream, in the outlet passage, from the connecting position 15*a* by a distance equal to or greater than the passage height Hb (see FIG. 4) at the winding end portion 19 along the axial direction of the centrifugal compressor 1.

Generally, in a centrifugal compressor, the flow passage shape (hereinafter referred to simply as cross-sectional shape) 13X of the scroll passage 13 in a cross-section extending in the direction perpendicular to the centerline AX of the scroll passage 13 is not circular in the cross-section including the tongue portion 25. On the other hand, the flow passage shape (cross-sectional shape) 15X of the outlet passage 15 in a cross-section extending in the direction perpendicular to the extension direction of the passage is typically circular. Therefore, if the cross-sectional shape of the passage changes abruptly from the scroll passage 13 to the outlet passage 15, loss occurs, resulting in a decrease in the efficiency of the centrifugal compressor 1.

As a result of intensive studies by the inventors, it has been found that when the cross-sectional shape of the passage is made approach circular over a distance equal to or greater than the passage height Hb of the winding end portion 19 along the axial direction of the centrifugal compressor 1 as described above, the loss can be effectively reduced.

Therefore, according to some embodiments, it is possible to effectively suppress the loss occurring in the passage from the scroll passage 13 to the outlet passage 15, and it is possible to increase the efficiency of the centrifugal compressor 1 over a wide operating range.

The embodiment in which the cross-sectional shape of the passage approaches circular over a distance equal to or greater than the passage height Hb may be implemented together with at least any one of the above-described embodiments.

The present invention is not limited to the embodiments described above, but includes modifications to the embodiments described above, and embodiments composed of combinations of those embodiments.

REFERENCE SIGNS LIST

1 Centrifugal compressor
9 Compressor housing (Casing)
10 Scroll structure
13 Scroll passage
15 Outlet passage
17 Winding start portion
19 Winding end portion
20 Passage connecting portion
25 Tongue portion
30 Connection region
50 Ridge portion

The invention claimed is:

1. A scroll structure of a centrifugal compressor having a scroll passage formed in spiral shape and having a larger dimension in an axial direction of the centrifugal compressor at a winding end portion of the scroll passage than at a winding start portion of the scroll passage, comprising:

a tongue portion separating the scroll passage from an outlet passage connected to a downstream side of the scroll passage at a most downstream position of the scroll passage in a passage connecting portion where the winding start portion and the winding end portion intersect; and a ridge portion protruding from an inner peripheral surface of the scroll passage on an axially downstream side of the centrifugal compressor toward an axially upstream side of the centrifugal compressor, wherein a protruding height of the ridge portion protruding toward the axially upstream side gradually increases toward the tongue portion from a starting position that is located upstream from the tongue portion in the scroll passage, and wherein a circumferential length of the tongue portion of the centrifugal compressor from the winding start portion to the tongue portion is longer than the protruding height, wherein the starting position is a position at an angle of 8 degrees or less in a circumferential direction of the centrifugal compressor from the tongue portion toward an upstream side of the scroll passage.

2. The scroll structure of a centrifugal compressor according to claim 1, wherein a flow passage shape of the scroll passage in a cross-section extending in a direction perpendicular to a centerline of the scroll passage is not circular in the cross-section including the tongue portion, wherein a flow passage shape of the outlet passage in a cross-section extending in a direction perpendicular to a centerline of the outlet passage approaches circular as the outlet passage extends downstream from a connecting position with the scroll passage, and wherein a position where the flow passage shape of the outlet passage changes from a non-circular shape to a circular shape is downstream of the outlet passage from the connecting position by a distance equal to or greater than a passage height at the winding end portion along an axial direction of the centrifugal compressor.

3. A centrifugal compressor, comprising the scroll structure of a centrifugal compressor according to claim 1.

4. The scroll structure of a centrifugal compressor according to claim 1, wherein the protruding height in a position at an angle of 4 degrees in a circumferential direction of the centrifugal compressor from the tongue portion toward an upstream side of the scroll passage is 10% or less of a height dimension of the scroll passage at the winding start portion along an axial direction of the centrifugal compressor.

5. The scroll structure of a centrifugal compressor according to claim 1, wherein the protruding height is 30% or less of a height dimension of the scroll passage at the winding start portion along an axial direction of the centrifugal compressor.

6. The scroll structure of a centrifugal compressor according to claim 1, wherein the curvature radius of a curve connecting an apex of the ridge portion defining the protruding height from the tongue portion to the starting position is located on the axially, upstream side, and wherein the curvature radius gradually increases from the tongue portion to the starting position in at least a portion of the apex.

7. A scroll structure of a centrifugal compressor having a scroll passage formed in spiral shape and having a larger dimension in an axial direction of the centrifugal compressor at a winding end portion of the scroll passage than at a winding start portion of the scroll passage, comprising:

a tongue portion separating the scroll passage from an outlet passage connected to a downstream side of the scroll passage at a most downstream position of the scroll passage in a passage connecting portion where the winding start portion and the winding end portion intersect; and a ridge portion protruding from an inner peripheral surface of the scroll passage on an axially downstream side of the centrifugal compressor toward an axially upstream side of the centrifugal compressor, wherein a protruding height of the ridge portion protruding toward the axially upstream side gradually increases toward the tongue portion from a starting position that is located upstream from the tongue portion in the scroll passage, and wherein a circumferential length of the tongue portion of the centrifugal compressor from the winding start portion to the tongue portion is longer than the protruding height, wherein the protruding height in a position at an angle of 4 degrees in a circumferential direction of the centrifugal compressor from the tongue portion toward an upstream side of the scroll passage is 10% or less of a height dimension of the scroll passage at the winding start portion along an axial direction of the centrifugal compressor.

8. The scroll structure of a centrifugal compressor according to claim 7 wherein a flow passage shape of the scroll passage in a cross-section extending in a direction perpendicular to a centerline of the scroll passage is not circular in the cross-section including the tongue portion, wherein a flow passage shape of the outlet passage in a cross-section extending in a direction perpendicular to a centerline of the outlet passage approaches circular as the outlet passage extends downstream from a connecting position with the scroll passage, and wherein a position where the flow passage shape of the outlet passage changes from a non-circular shape to a circular shape is downstream of the outlet passage from the connecting position by a distance equal to or greater than a passage height at the winding end portion along an axial direction of the centrifugal compressor.

9. A centrifugal compressor, comprising the scroll structure of a centrifugal compressor according to claim 7.

10. A scroll structure of a centrifugal compressor having a scroll passage formed in spiral shape and formed so that a cross-sectional area of the scroll passage increases from a winding start portion of the scroll passage to a winding end portion of the scroll passage, comprising:

a tongue portion separating the scroll passage from an outlet passage connected to a downstream side of the scroll passage at a most downstream position of the scroll passage in a passage connecting portion where the winding start portion and the winding end portion intersect; and a ridge portion protruding from an inner peripheral surface of the scroll passage on an axially downstream side of the centrifugal compressor toward an axially upstream side of the centrifugal compressor, wherein a protruding height of the ridge portion protruding toward the axially upstream side gradually increases toward the tongue portion from a starting position that is located upstream from the tongue portion in the scroll passage, wherein the protruding height is 30% or less of a height dimension along an axial direction of the centrifugal compressor at a position where the cross-sectional area of the scroll flow passage is a smallest.

11. The scroll structure of a centrifugal compressor according to claim 10 wherein a flow passage shape of the scroll passage in a cross-section extending in a direction perpendicular to a centerline of the scroll passage is not circular in the cross-section including the tongue portion, wherein a flow passage shape of the outlet passage in a cross-section extending in a direction perpendicular to a centerline of the outlet passage approaches circular as the outlet passage extends downstream from a connecting position with the scroll passage, and wherein a position where the flow passage shape of the outlet passage changes from a non-circular shape to a circular shape is downstream of the outlet passage from the connecting position by a distance equal to or greater than a passage height at the winding end portion along an axial direction of the centrifugal compressor.

12. A centrifugal compressor, comprising the scroll structure of a centrifugal compressor according to claim 10.

13. A scroll structure of a centrifugal compressor having a scroll passage formed in spiral shape, comprising:

a tongue portion separating the scroll passage from an outlet passage connected to a downstream side of the scroll passage at a most downstream position of the scroll passage in a passage connecting portion where a winding start portion and a winding end portion of the scroll passage intersect; and a ridge portion protruding from an inner peripheral surface of the scroll passage on an axially downstream side of the centrifugal compressor toward an axially upstream side of the centrifugal compressor, wherein a protruding height of the ridge portion protruding toward the axially upstream side gradually increases toward the tongue portion from a starting position that is located upstream from the tongue portion in the scroll passage, wherein a curvature radius of a curve connecting an apex of the ridge portion defining the protruding height from the tongue portion to the starting position is located on the axially upstream side, and wherein the curvature radius gradually increases from the tongue portion to the starting position in at least a portion of the apex.

14. The scroll structure of a centrifugal compressor according to claim 13 wherein a flow passage shape of the scroll passage in a cross-section extending in a direction perpendicular to a centerline of the scroll passage is not circular in the cross-section including the tongue portion, wherein a flow passage shape of the outlet passage in a cross-section extending in a direction perpendicular to a centerline of the outlet passage approaches circular as the outlet passage extends downstream from a connecting position with the scroll passage, and wherein a position where the flow passage shape of the outlet passage changes from a non-circular shape to a circular shape is downstream of the outlet passage from the connecting position by a distance equal to or greater than a passage height at the winding end portion along an axial direction of the centrifugal compressor.

15. A centrifugal compressor, comprising the scroll structure of a centrifugal compressor according to claim 13.

* * * * *